US007976233B2

(12) United States Patent
Onuki

(10) Patent No.: US 7,976,233 B2
(45) Date of Patent: Jul. 12, 2011

(54) WINDING APPARATUS

(75) Inventor: Kazuhiko Onuki, Meguro-ku (JP)

(73) Assignee: Canon Kabushiki Kaisha, Tokyo (JP)

( * ) Notice: Subject to any disclaimer, the term of this patent is extended or adjusted under 35 U.S.C. 154(b) by 427 days.

(21) Appl. No.: 11/558,385

(22) Filed: Nov. 9, 2006

(65) Prior Publication Data

US 2007/0116505 A1 May 24, 2007

(30) Foreign Application Priority Data

Nov. 24, 2005 (JP) ..... 2005-338586

(51) Int. Cl.
*B65H 75/22* (2006.01)
*B65H 19/22* (2006.01)

(52) U.S. Cl. ..... 400/614; 400/613; 242/532.5; 242/533; 242/596.4

(58) Field of Classification Search ..... 242/579, 242/585, 586, 586.2, 587, 532, 532.5, 533, 242/596.4, 596.5, 541.2; 400/614, 527.2, 400/649, 659, 613; 24/462; 101/409; *B65H 75/22, B65H 19/22*

See application file for complete search history.

(56) References Cited

U.S. PATENT DOCUMENTS

| | | | | |
|---|---|---|---|---|
| 4,346,856 | A | 8/1982 | Paietta | |
| 4,627,754 | A * | 12/1986 | Sholtis et al. | 400/649 |
| 6,722,011 | B1 * | 4/2004 | Bacon | 29/451 |
| 2003/0154579 | A1 * | 8/2003 | Disher | 24/462 |

FOREIGN PATENT DOCUMENTS

| | | | |
|---|---|---|---|
| JP | 11-060018 | A | 3/1999 |
| JP | 11-139636 | A | 5/1999 |
| JP | 2001354340 | A * | 12/2001 |
| JP | 2002-356260 | A | 12/2002 |
| JP | 2003-182893 | A | 7/2003 |

* cited by examiner

*Primary Examiner* — Daniel J Colilla
*Assistant Examiner* — Jennifer Simmons
(74) *Attorney, Agent, or Firm* — Canon USA, Inc. IP Div

(57) ABSTRACT

A winding apparatus for use in a copier, a printer, and other devices for ejecting a printed sheet in a rolled form of a cylinder without having a core includes a gripping mechanism for gripping the leading end of a sheet when the sheet is rolled into cylindrical form. The gripping mechanism is disposed on a cylindrical member provided to each of both ends of the sheet in a direction orthogonal to a conveyance direction of the sheet and moving with the conveyance of the sheet. The on and off states of gripping to the leading end of the sheet can be controlled. The gripping mechanism is turned to the off state, and the cylindrical member is retracted from the sheet.

12 Claims, 13 Drawing Sheets

WINDING APPARATUS

BACKGROUND OF THE INVENTION

1. Field of the Invention

The present invention relates to a winding apparatus, and in particular, to a winding apparatus for use in a copier, a printer, and other devices for ejecting a printed sheet rolled in the form of a cylinder without having a core.

2. Description of the Related Art

For an apparatus that prints a long sheet extending for several meters, such as a copier that prints advertisement or a long-format printer, one print method is to use a continuous sheet and to wind the sheet in roll form without cutting it after completing a single printing operation. In this method, the sheet is required to be cut afterward. Another print method is to cut a sheet with a cutter when a single printing operation is completed and to store the cut sheet on a flat output tray. In this method, an enormous space is required (see, for example, Japanese Patent Laid-Open No. 2002-356260).

A paper storage device that stores a sheet while rolling the sheet into cylindrical form has been proposed (see, for example, Japanese Patent Laid-Open No. 11-060018). Also a device for attaching tape onto the trailing end of a sheet to maintain a rolled state of the rolled sheet in cylindrical form has been proposed (see, for example, Japanese Patent Laid-Open No. 11-139636).

The paper storage device disclosed in Japanese Patent Laid-Open No. 11-060018 has a structure in which a pair of upstream rollers pushes a sheet into a storing unit disposed to roll sheets. Therefore, the storage device includes driving rollers at several points of the storing unit in order to prevent the sheet from buckling in process of being rolled. However, even with such a structure, very thin paper is in danger of buckling. In addition, because the driving rollers are rotated at a higher speed than the speed of conveying the sheet, in the case where a sheet of thick paper is used, the driving rollers may cause damage to the surface of the sheet.

Therefore, it would be desirable to provide a winding apparatus capable of rolling a sheet into cylindrical form for use in a copier, a printer, and other devices stably irrespective of the thickness of the sheet without causing the sheet to buckle or damaging the surface of the sheet.

SUMMARY OF THE INVENTION

According to an aspect of the present invention, a winding apparatus is provided which is capable of rolling a sheet into cylindrical form for use in a copier, a printer, and other devices stably irrespective of the thickness of the sheet without causing the sheet to buckle or damaging the surface of the sheet.

According to another aspect of the present invention, the winding apparatus includes a gripping mechanism for gripping the leading end of a sheet when the sheet is rolled into cylindrical form in a copier, a printer, and other devices for ejecting a printed sheet in a rolled form of a cylinder without having a core.

According to yet another aspect of the present invention, the winding apparatus is capable of allowing continuous printing and of facilitating the ease of handling sheets for use in a copier, a printer, and other devices. Moreover, according to another aspect of the present invention, the winding apparatus is capable of storing a sheet without causing the sheet to be unfolded.

Furthermore, according to another aspect of the present invention, a sheet winding apparatus is provided which includes a core member configured to wind a sheet therearound; a fixing unit configured to fix a leading end of the sheet to the core member; a rotating unit configured to rotate the core member to wind the sheet around the core member; and a moving unit configured to move the core member to remove the core member from a sheet roll of the sheet wound around the core member.

Additionally, according to another aspect of the present invention, the sheet winding apparatus may further include an attaching unit configured to attach a holding member to the sheet roll, the holding member being configured to hold a rolled state of the sheet roll. In another aspect of the present invention, after the attaching unit attaches the holding member to the sheet roll, the moving unit moves the core member. Moreover, according to still another aspect of the present invention, the holding member includes an elastic material having a circular ring-shape with a pair of terminus ends forming a discontinuous gap therebetween.

And still further, according to another aspect of the present application, the sheet winding apparatus may further include a releasing unit configured to release the sheet from the fixing unit, wherein, after the releasing unit releases the sheet from the core member, the moving unit moves the core member.

Furthermore, according to another aspect of the present application, the core member is disposed on each of both ends of the sheet. Also, according to another aspect of the present application, a speed of a periphery of the core member during rotation is slower than an average speed of conveying the sheet on at least an initial first lap.

And still yet, according to another aspect of the present invention, a recording device is provided which includes a recording unit configured to perform printing on a sheet; a core member configured to wind the sheet printed by the recording unit therearound; a fixing unit configured to fix a leading end of the sheet to the core member; a rotating unit configured to rotate the core member to wind the sheet around the core member; and a moving unit configured to move the core member to remove the core member from a sheet roll of the sheet wound around the core member.

Further features of the present invention will become apparent from the following description of exemplary embodiments with reference to the attached drawings.

DESCRIPTION OF THE EMBODIMENTS

Figure 1:
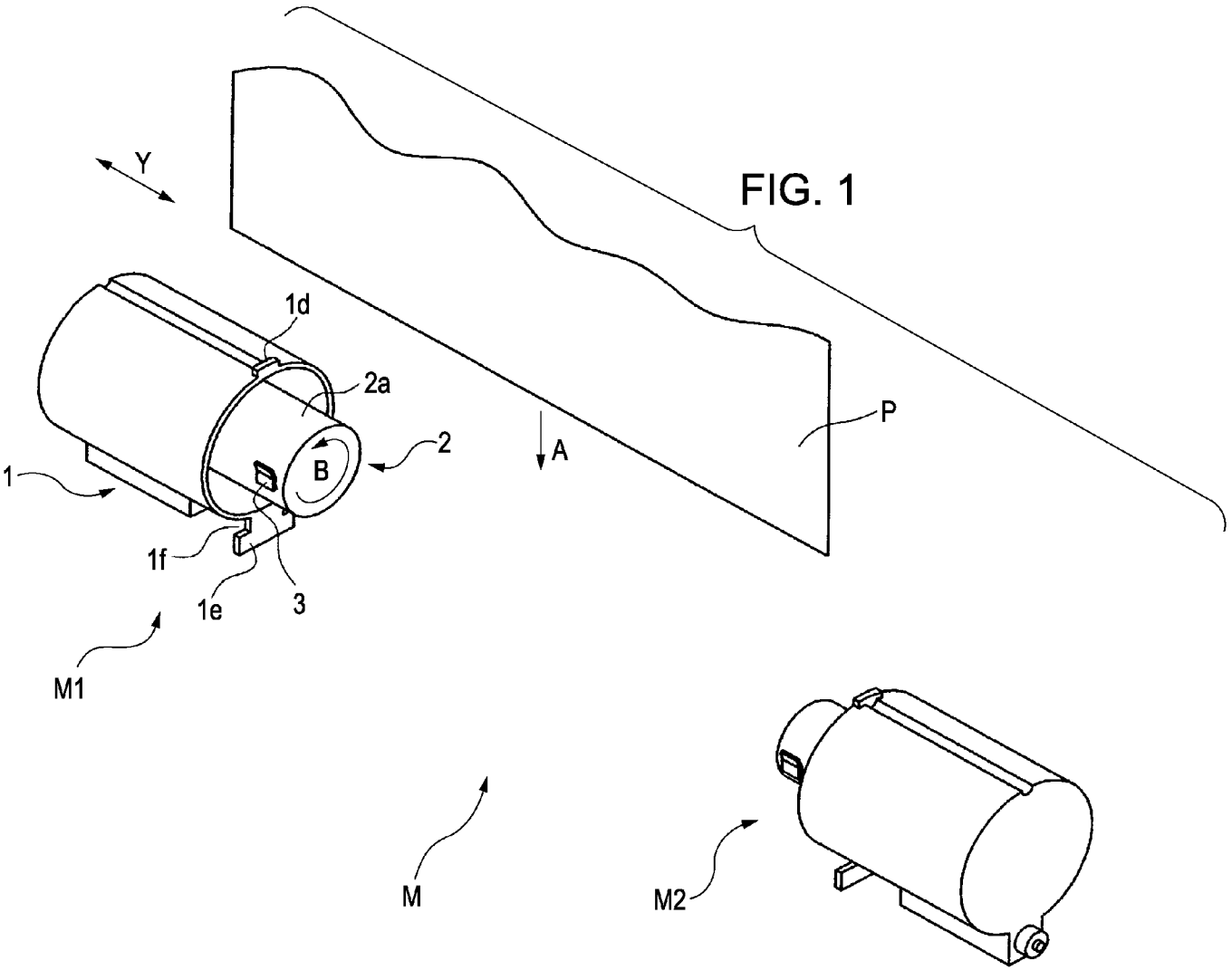
FIG. 1 is a perspective view of an exemplary winding apparatus in a large format printer according to an aspect of the present invention.

Various embodiments, features and aspects of the aforementioned invention will now herein be described with reference to the attached drawings. FIG. 1 is a perspective view of winding apparatus in a large format printer according to an exemplary embodiment of the present invention.

A sheet P is a long sheet that has been printed by a large format printer and has been ejected from a main body of the printer and is conveyed in the direction of the arrow A. A winding apparatus M includes winding units M1 and M2, rolls a cut printed long sheet into cylindrical form, and stores the rolled sheet on a tray disposed below (not shown). The winding units M1 and M2 are symmetrical to each other and disposed on opposite sides in the width direction of the sheet P. The winding unit M2 can move in the Y direction depending on the width of the sheet P.

Figure 2:
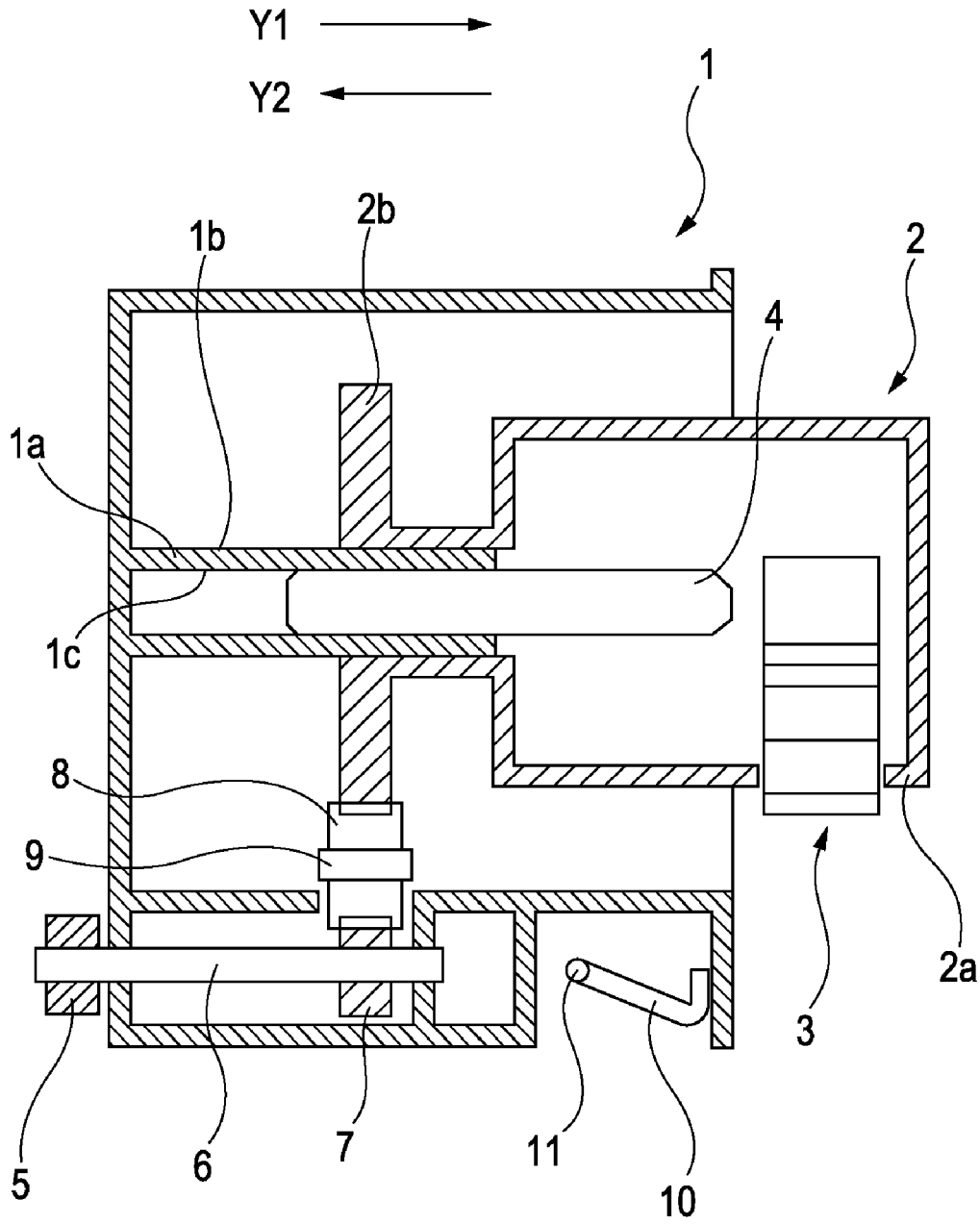
FIG. 2 is a cross-sectional view of the winding apparatus according to an aspect of the present invention.

The winding unit M1 includes a casing 1 having a substantially cylindrical shape. FIG. 2 illustrates a cross section of the winding unit M1. A paper tube (core member, a winding member, or a cylindrical member) 2 can rotate in the direction of the arrow B (see FIG. 1), and move in the directions of the arrows Y1 and Y2, on an outer surface 1*b* of a cylindrical portion 1*a* of the casing 1. The movement of the paper tube 2 in the Y1 and Y2 directions is performed by a moving unit. The moving unit includes a movement motor 102 (see FIG. 15), a pinion driven by the movement motor 102, and a rack meshing with the pinion and moving integrally with the paper tube 2.

A gripper (fixing unit) 3 functions as a fixing unit for fixing the leading end of a sheet to the paper tube 2. The gripper 3 is provided on the paper tube 2 and is made of a flexible material. The gripper 3 can move in a radial direction of the paper tube 2 and grips the leading end of the sheet P by holding the leading end of the sheet P between the gripper 3 and a periphery 2*a* of the paper tube 2. A switching shaft 4 functions as a releasing unit and can switch on and off a gripping mechanism of the gripper 3 by sliding along the Y1 and Y2 directions on an inner surface 1*c* of the cylindrical portion 1*a* of the casing 1 by driving of an actuator 103 (see FIG. 15).

A gear system for rotating the paper tube 2 functions as a rotating unit and includes a gear 5 meshing with an output gear of a winding motor 101 (see FIG. 15), a gear shaft 6 for transmitting driving of the gear 5, a gear 7 for transmitting driving of the gear shaft 6, a gear 8 meshing with the gear 7, and a central shaft 9 of the gear 8. The paper tube 2 is rotated by rotation of a gear portion 2*b* thereof meshing with the gear 8 driven by the driving system receiving driving of the main body. An ejection rod 10 is pivoted about a pivot point 11 by a cam driven a cam motor 104 (see FIG. 15).

Figure 15:
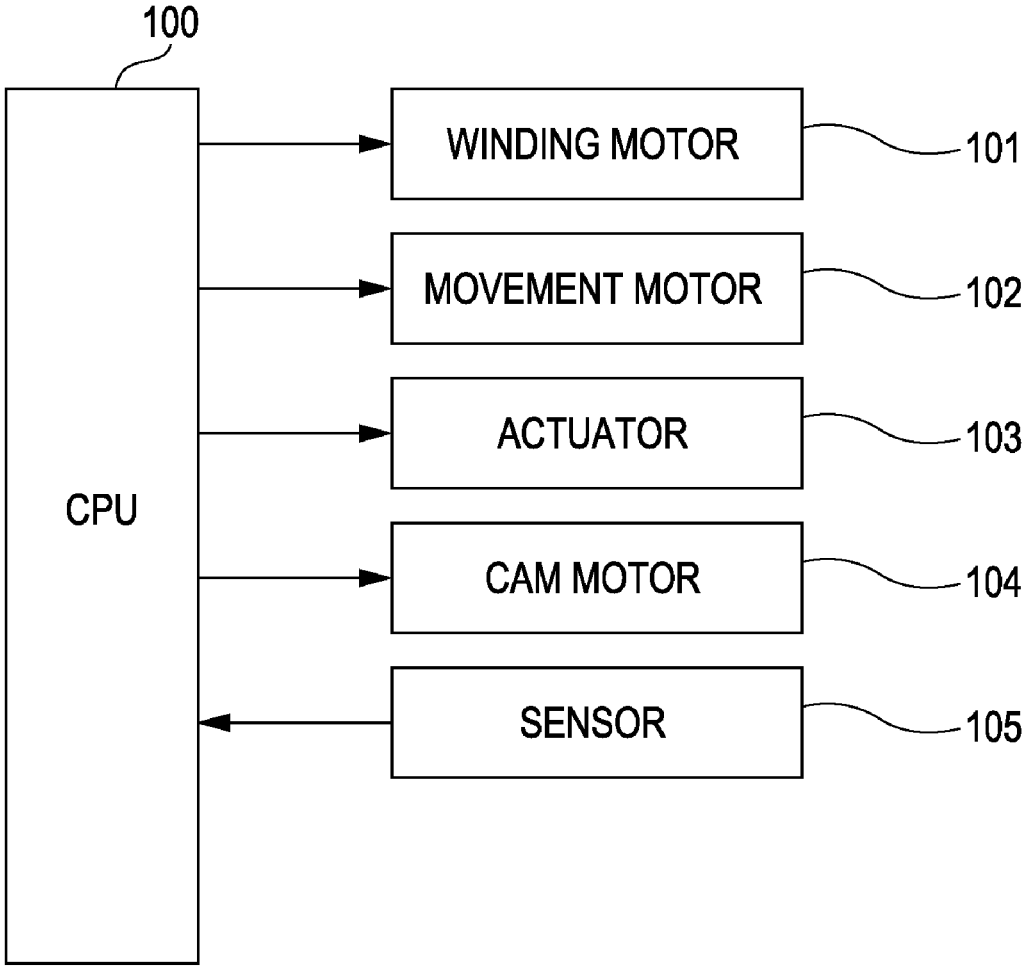
FIG. 15 is a block diagram of exemplary circuitry of the winding apparatus according to an aspect of the present invention.

FIG. 15 is a block diagram of exemplary circuitry controlling the winding apparatus. As shown in FIG. 15, a CPU 100 is in communication with the winding motor 101, the movement motor 102, the actuator 103, the cam motor 104 and the sensor 105.

Figure 16:
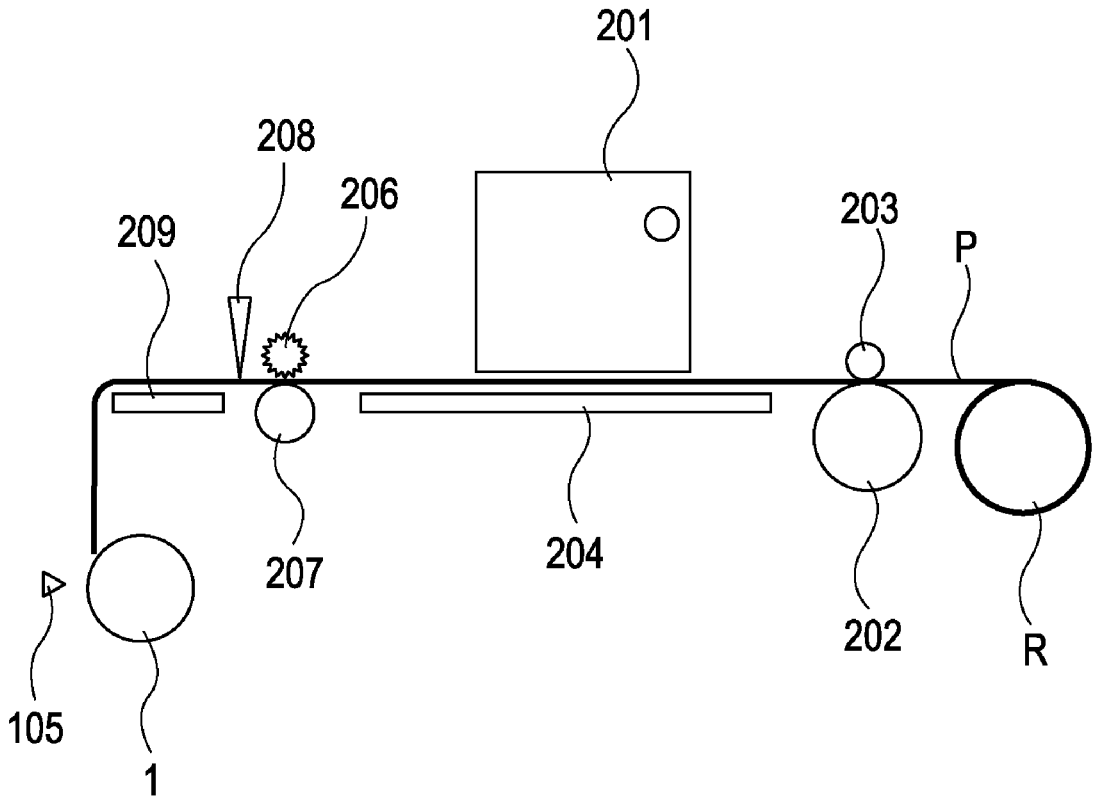
FIG. 16 illustrates an exemplary recording device including the winding apparatus according to an aspect of the present invention.

FIG. 16 illustrates a recording device including the winding apparatus. In FIG. 16, a sheet P is a recording sheet unwound from a sheet roll R of rolled paper. A recording head 201 discharges ink at the sheet P on the basis of image information while reciprocating along the width direction of the sheet P and records an image on the sheet P. A conveyance roller 202 conveys the sheet P. A pinch roller 203 presses the sheet P against the conveyance roller 202. A platen 204 supports the sheet P at a position that faces the recording head 201. An ejection roller 207 ejects the sheet P. A spur roller 206 presses the sheet P against the ejection roller 207.

A cutter 208 cuts the sheet P after recording is completed. An ejection guide 209 guides the sheet P to be ejected. A sensor 105 detects that the leading end of the sheet P comes into contact with the gripper 3.

Figure 3:
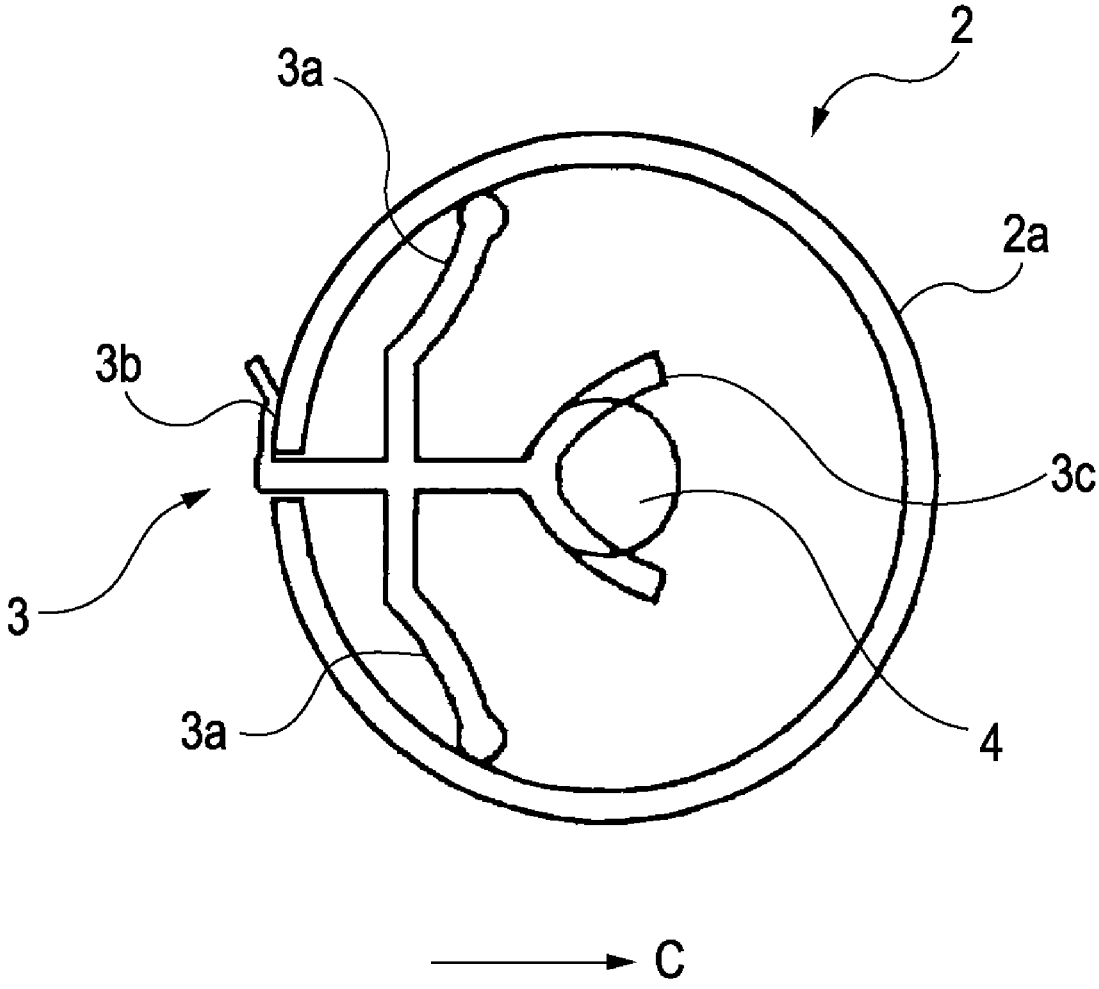
FIG. 3 is an illustration of an exemplary operation of a gripper in an initial state according to an aspect of the present invention.
Figure 4:
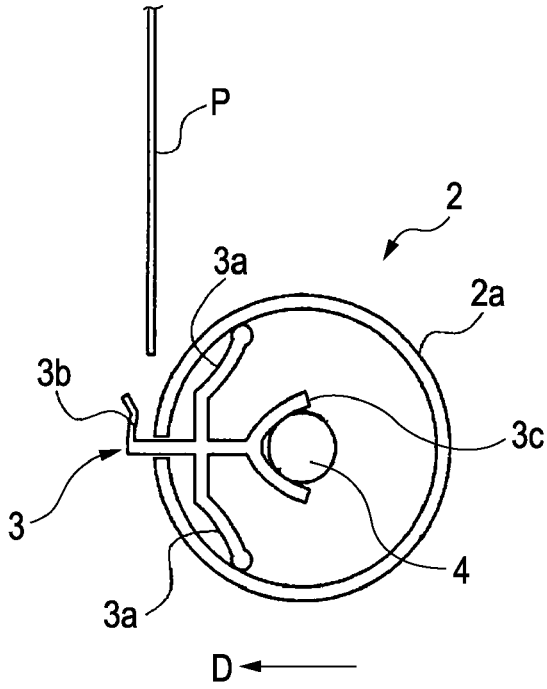
FIG. 4 is an illustration for an exemplary operation of a gripper in a state of being ready for gripping a sheet according to an aspect of the present invention.
Figure 5:
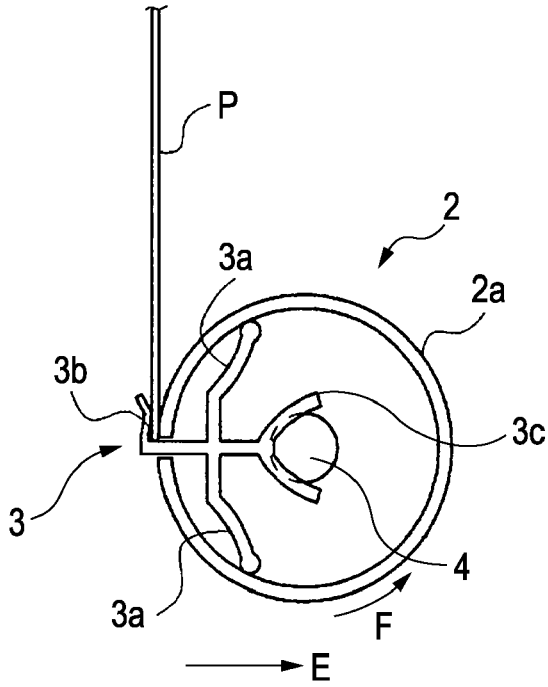
FIG. 5 is an illustration of an exemplary operation of the gripper in a state in which the gripper grips the sheet according to an aspect of the present invention.
Figure 17:
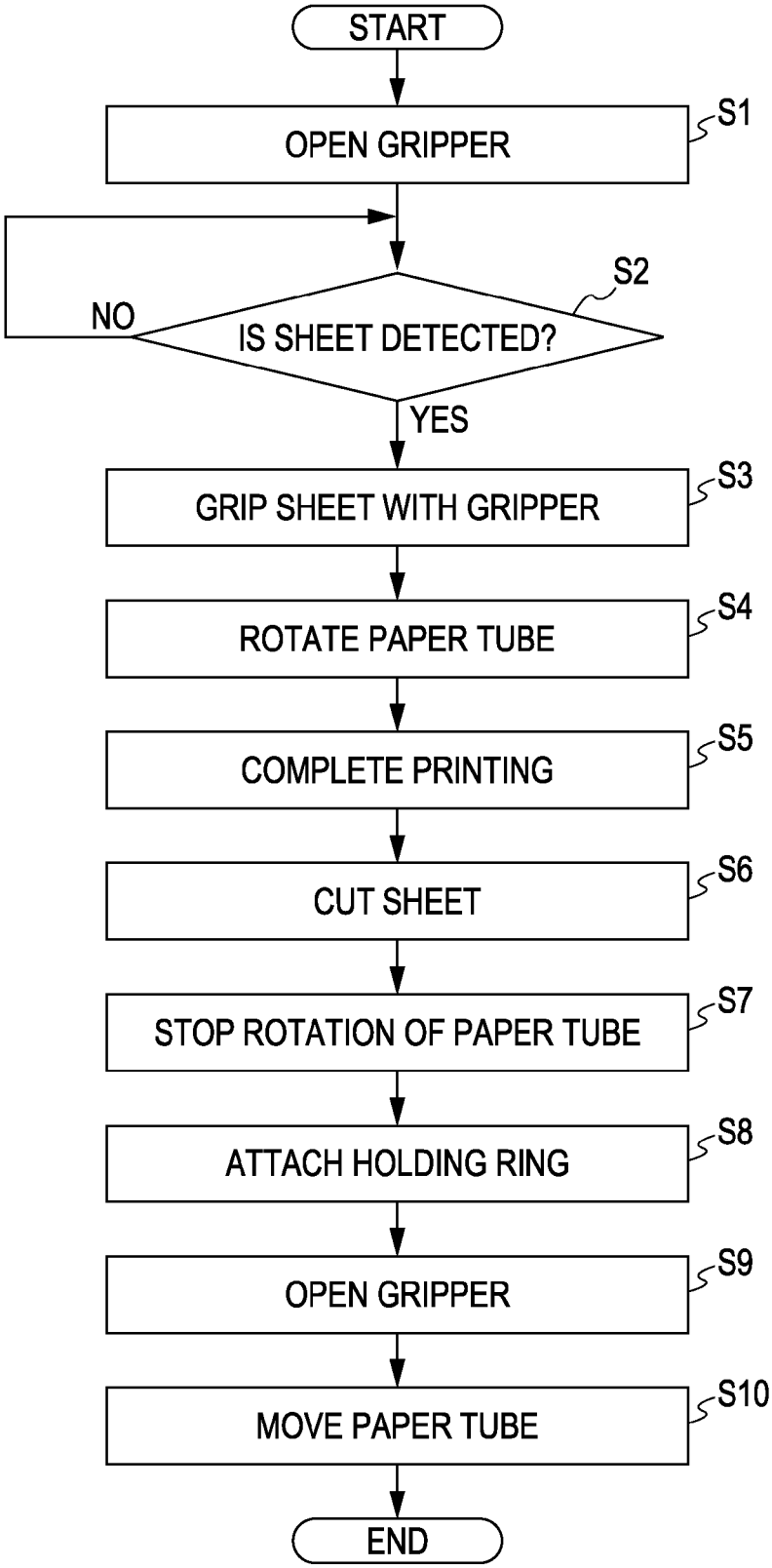
FIG. 17 is a flowchart for exemplary processing performed by the winding apparatus according to an aspect of the present invention.

An operation of the winding apparatus according to the exemplary embodiment is described below with reference to a flowchart shown in FIG. 17, while FIGS. 3 through 5 illustrate how the leading end of the sheet P is gripped. In FIG. 3, the winding apparatus is on standby, and the switching shaft 4 is not in contact with the gripper 3, as illustrated in FIG. 2. The gripper 3 provided on the paper tube 2 is biased toward the direction of the arrow C by the function of a flexible spring portion 3*a*. A grip surface 3*b* of the gripper 3 is pressed against the periphery 2*a* of the paper tube 2, and the gripper 3 is thus stably maintained. The circumferential position of the gripper 3 is controlled such that the angular position of the gripper 3 in the winding unit M1 is the same as that in the winding unit M2.

FIG. 4 illustrates a state in which the sheet P approaches the winding apparatus. When the sheet P approaches the winding apparatus from the state illustrated in FIG. 3, the switching shaft 4 slides along the Y1 direction (see FIG. 2) by driving of the actuator 103 (see FIG. 15). When the switching shaft 4 slides, the switching shaft 4 comes into contact with a Y-shaped portion 3*c* of the gripper 3 and pushes the gripper 3 in the direction of the arrow D against the force of the spring portion 3*a*. This generates a gap between the grip surface 3*b* of the gripper 3 and the periphery 2*a* of the paper tube 2. FIG. 4 illustrates this state (step S1 in FIG. 17).

FIG. 5 illustrates a state in which the leading end of the sheet P comes into contact with the gripper 3. When, in step S2, the sensor 105 detects that the leading end of the sheet P comes into contact with the gripper 3, the processing proceeds to step S3, in which the switching shaft 4 moves in the back direction in FIG. 5 (the Y2 direction in FIG. 2). The contact between the switching shaft 4 and the gripper 3 is released, and the gripper 3 moves in the direction of the arrow E by the function of the spring portion 3*a*. The grip surface 3*b* of the gripper 3 and the periphery 2*a* of the paper tube 2 grip the leading end of the sheet P.

From this state, in step S4, the paper tube 2 starts rotating in the direction of the arrow F. That is, in FIG. 2, when the output gear of the winding motor 101 rotates, the driving system 5 to 9 receive driving of the rotation and the gear portion 2*b* of the paper tube 2 rotate the paper tube 2. At this time, the speed of the periphery of the paper tube 2 during rotation is lower than the print speed of a printer (average conveyance speed of the sheet P) on at least the first turn. This generates a gap between the sheet P and the periphery of the paper tube 2 when the sheet P is rolled, thus reducing a possibility of damage to a sheet caused by tightly rolling the sheet and pressing the grip surface 3*b* of the gripper 3 between the surfaces of the rolled sheet.

Figure 6:
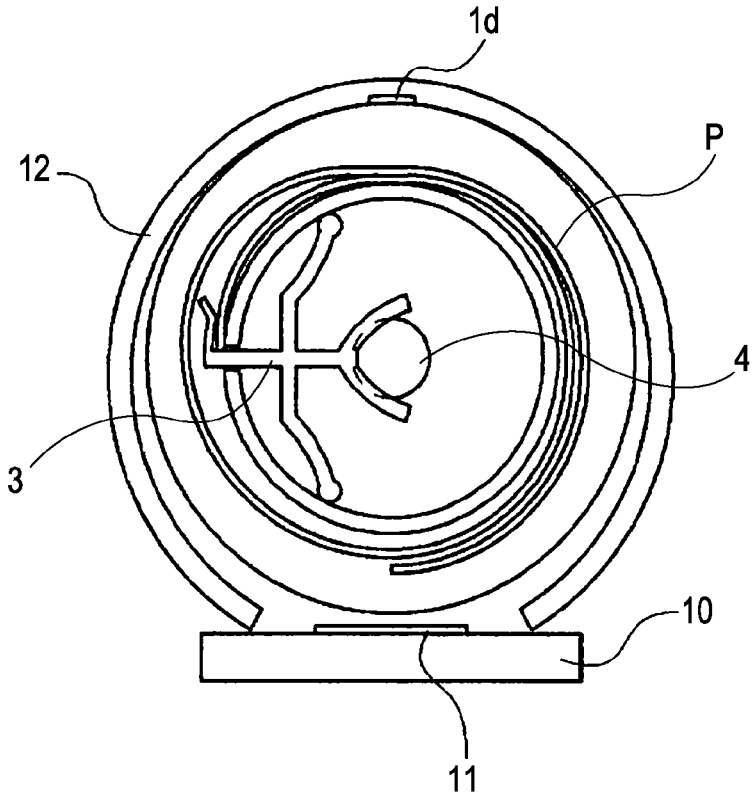
FIG. 6 illustrates an exemplary state in which winding all the sheet around a paper tube is completed according to an aspect of the present invention.
Figure 7:
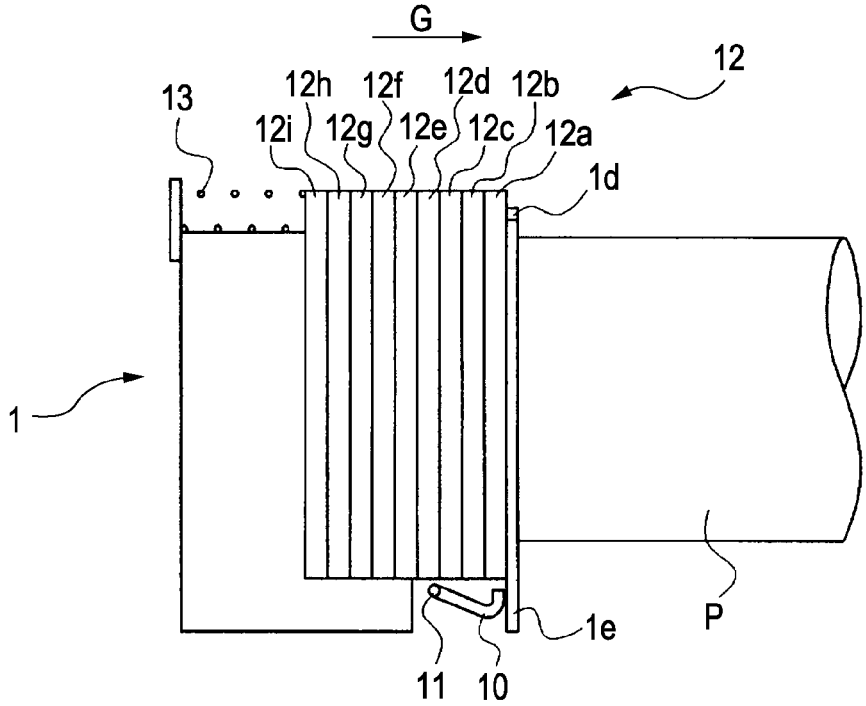
FIG. 7 illustrates an exemplary state prior to pushing a holding ring according to an aspect of the present invention.
Figure 8:
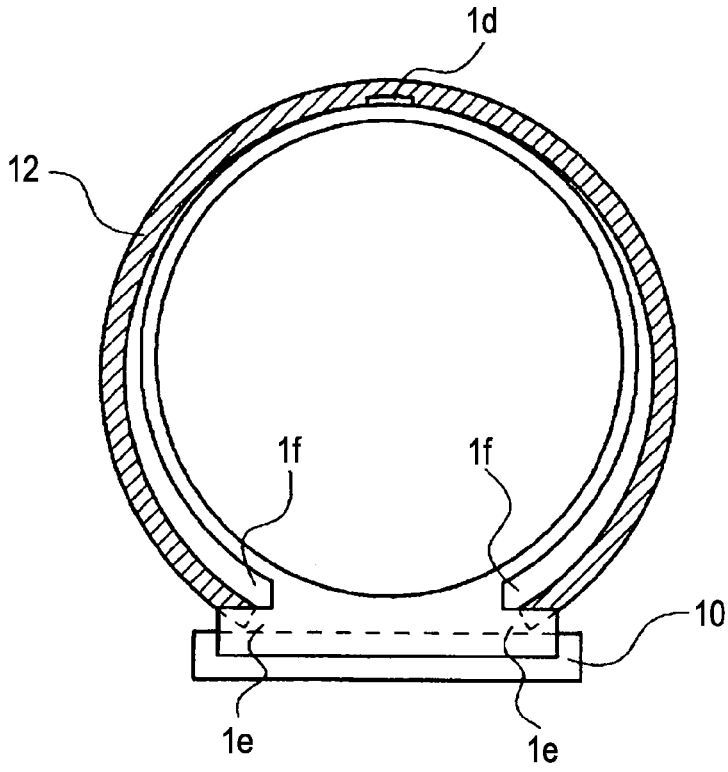
FIG. 8 is a cross-sectional view of the state shown in FIG. 7 according to an aspect of the present invention.

In step S5, printing is completed, and in step S6, the sheet P is cut. FIGS. 6 and 7 illustrate a state in which all the cut printed sheet P is wound around the paper tube 2, up to the trailing end of the sheet P, and the sheet P is formed in a sheet roll. When winding the sheet P around the paper tube 2 is completed, in step S7, the winding motor 101 is stopped and the rotation of the paper tube 2 is stopped. A holding ring 12 functions as a holding unit and is a member for pressing down a sheet finally rolled in cylindrical form so as to prevent the sheet from being unfolded. The holding ring 12 is elastic, has the shape of a ring having a discontinuous portion, and resembles the letter C (i.e. the ring has two terminus ends formed at the discontinuous portion). The plurality of holding rings 12 (12*a*, 12*b*, . . . , and 12*i* in FIG. 7) are disposed on the periphery of the casing 1. A spring 13 biases the holding rings 12 in the direction of the arrow G and is regulated by an upper projection 1*d* and a lower projection 1*e* of the casing 1 of the winding unit M1, which are shown in FIG. 1. FIG. 8 illustrates a cross-sectional view of this state.

Figure 9:
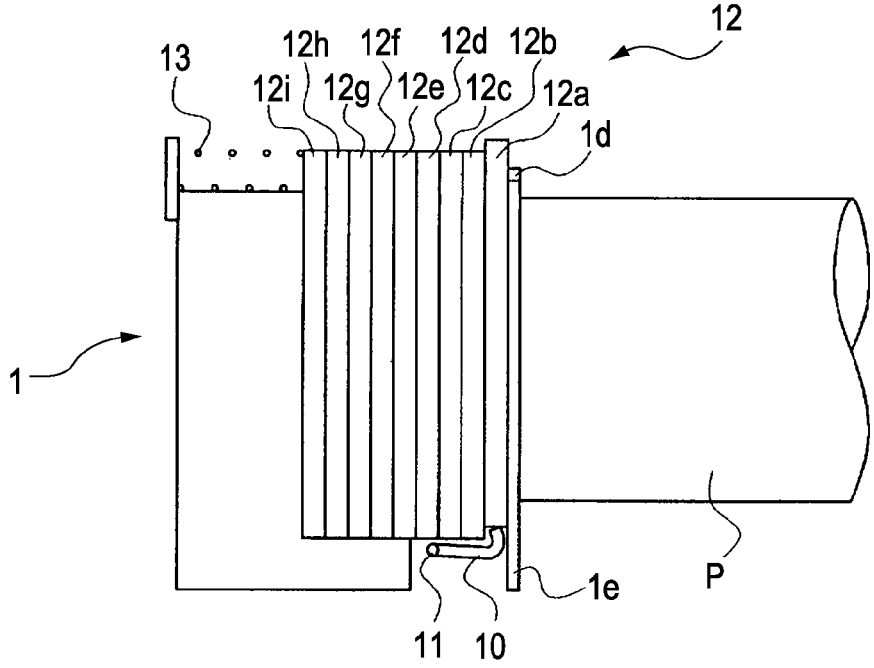
FIG. 9 illustrates an exemplary state prior to pushing and attaching the holding ring to the sheet according to an aspect of the present invention.
Figure 10:
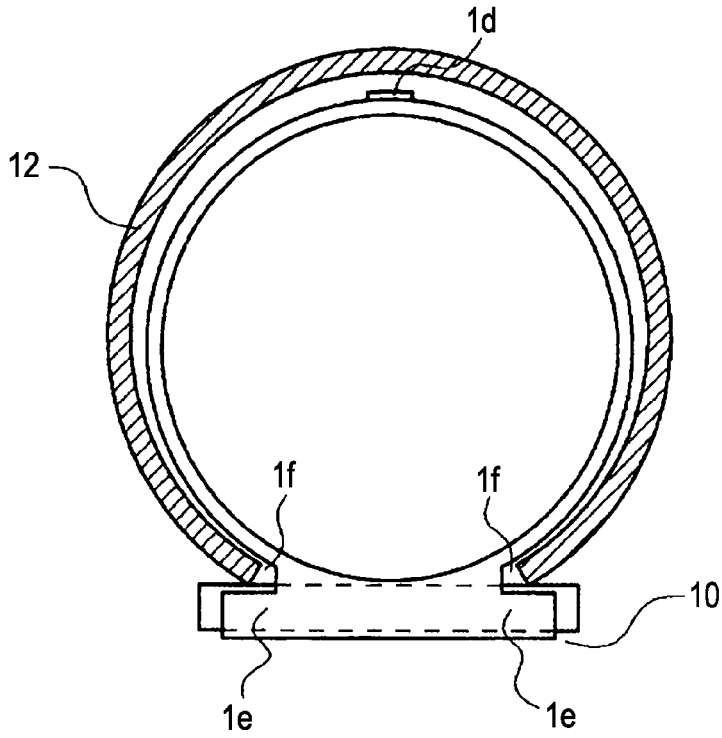
FIG. 10 is a cross-sectional view of the state shown in FIG. 9 according to an aspect of the present invention.
Figure 11:
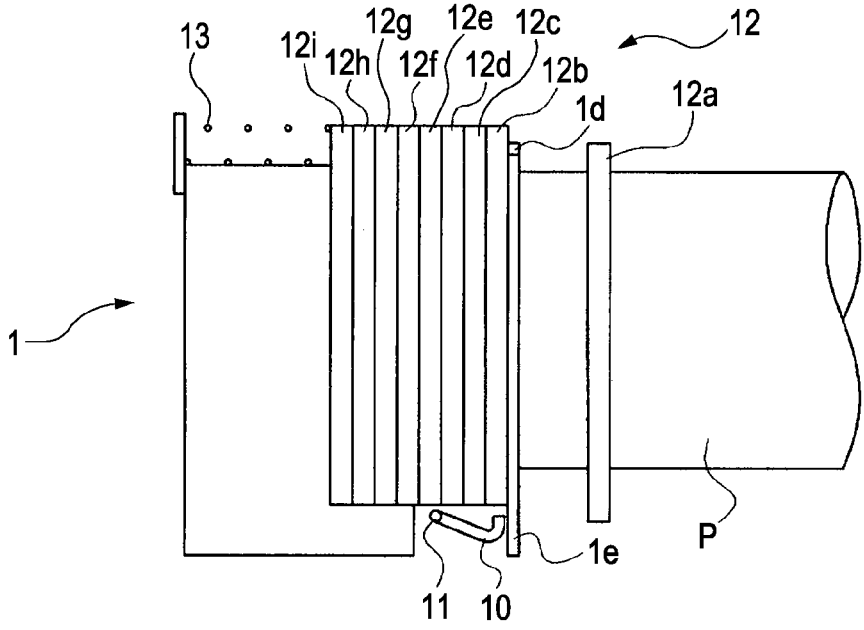
FIG. 11 illustrates an exemplary state in which the holding ring is attached to the sheet according to an aspect of the present invention.

FIGS. 9 and 10 illustrate how one of the holding rings 12 is ejected by the ejection rod 10, functioning as an attaching unit. In step S8, the ejection rod 10 is pivoted about the pivot point 11, thus upwardly pushing the rightmost holding ring 12*a* (being in contact with the upper projection 1*d* and the lower projection 1*e*). The upper portion of the holding ring 12*a* rides on the upper projection 1*d*, and the lower portion of the holding ring 12*a* rides on the lower projection 1*e* and enters a recess if, so that the regulation is released. Then the holding ring 12*a* is biased by the spring 13 and falls on the sheet rolled in cylindrical form (FIG. 11). As a result, the holding ring 12 prevents the sheet rolled in cylindrical form and finally in roll form from being unfolded.

The ejection rod 10 is pivoted in the reverse direction about the pivot point 11 and returns to an original position. The operation described above is also performed by the winding unit M2, so that one holding ring 12 is set on each of the both horizontal ends of the sheet rolled in cylindrical form, i.e., the two holding rings 12 are set in total on the sheet. The holding rings 12 can be removed from the casing 1 and replaced thereto, with respect to each of the winding units M1 and M2, at any time by detaching the spring 13.

Figure 12:
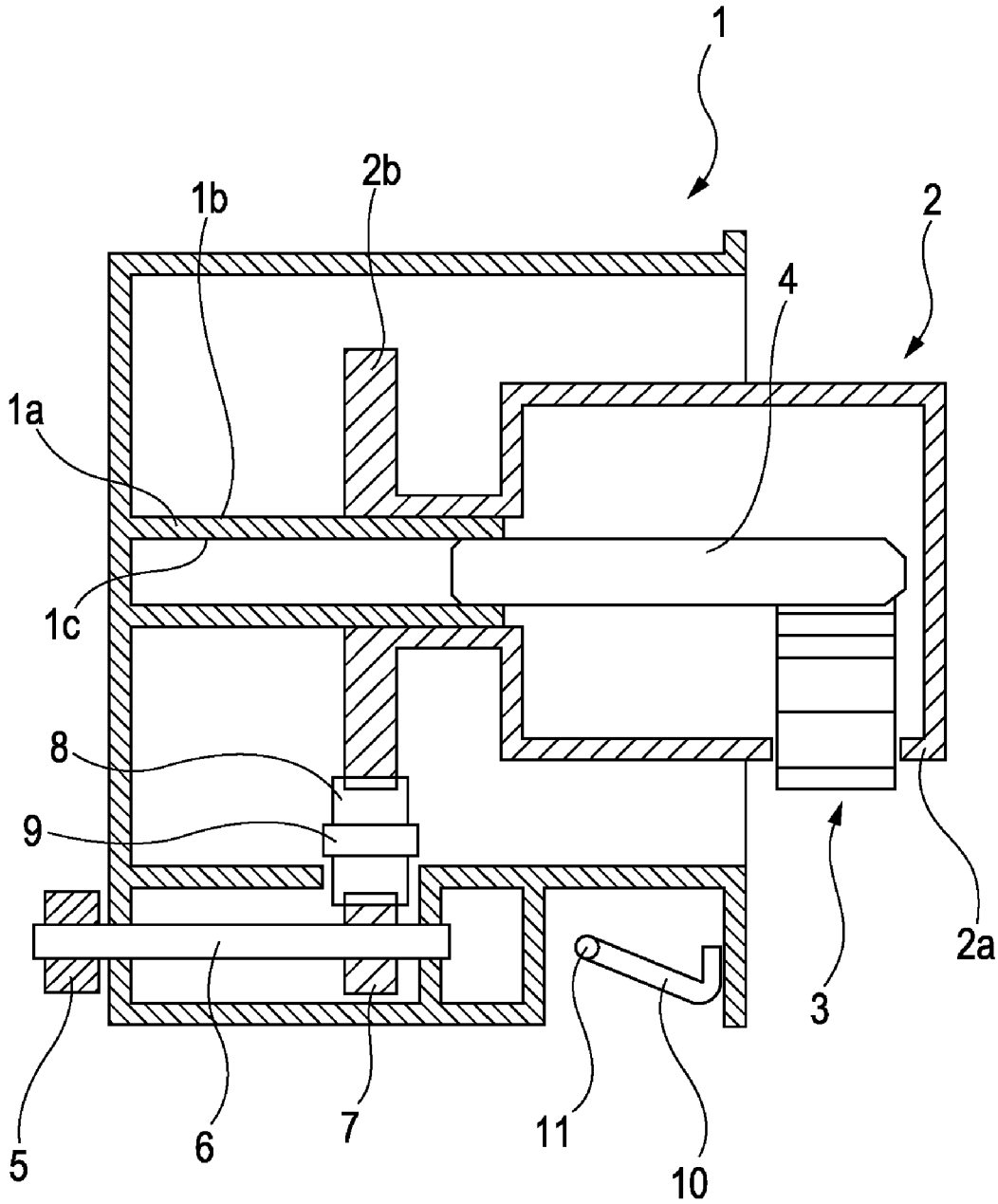
FIG. 12 illustrates an exemplary state in which gripping of the gripper is released according to an aspect of the present invention.
Figure 13:
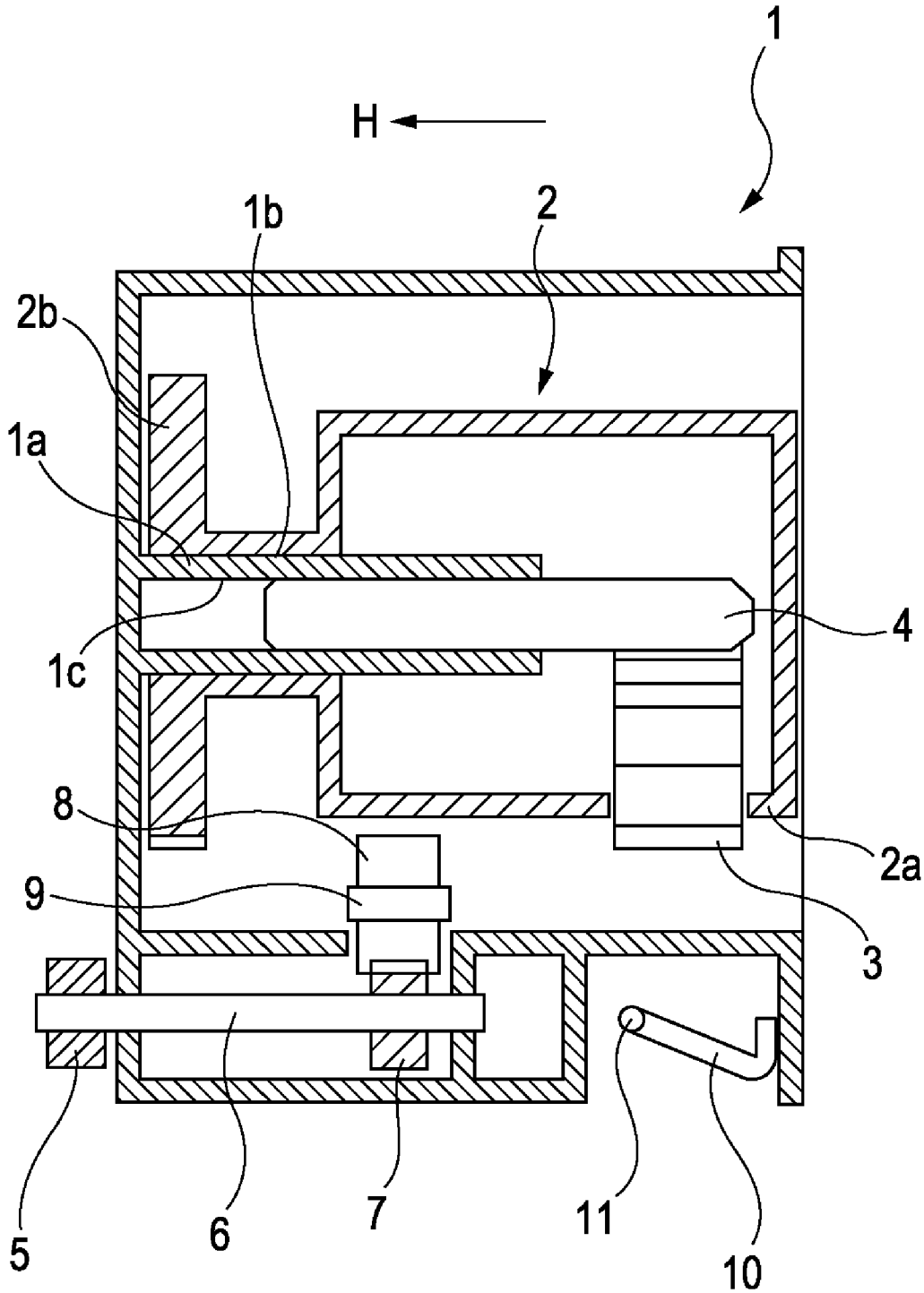
FIG. 13 illustrates an exemplary state in which the paper tube is retracted from the sheet rolled in cylindrical form according to an aspect of the present invention.

FIGS. 12 and 13 illustrate how a sheet rolled in cylindrical form falls. In FIGS. 12 and 13, the sheet rolled in cylindrical form is omitted and is not shown. In step S9, as illustrated in FIG. 12, in order to release the gripping of the leading end of the sheet P with the gripper 3, the switching shaft 4 slides. The position of the gripper 3 is the same as that shown in FIG. 4. When the switching shaft 4 slides, the switching shaft 4 comes into contact with the Y-shaped portion 3*c* of the gripper 3 and pushes the gripper 3 in the direction of the arrow D against the force of the spring portion 3*a*. This generates a gap between the grip surface 3*b* of the gripper 3 and the periphery 2*a* of the paper tube 2.

Figure 14:
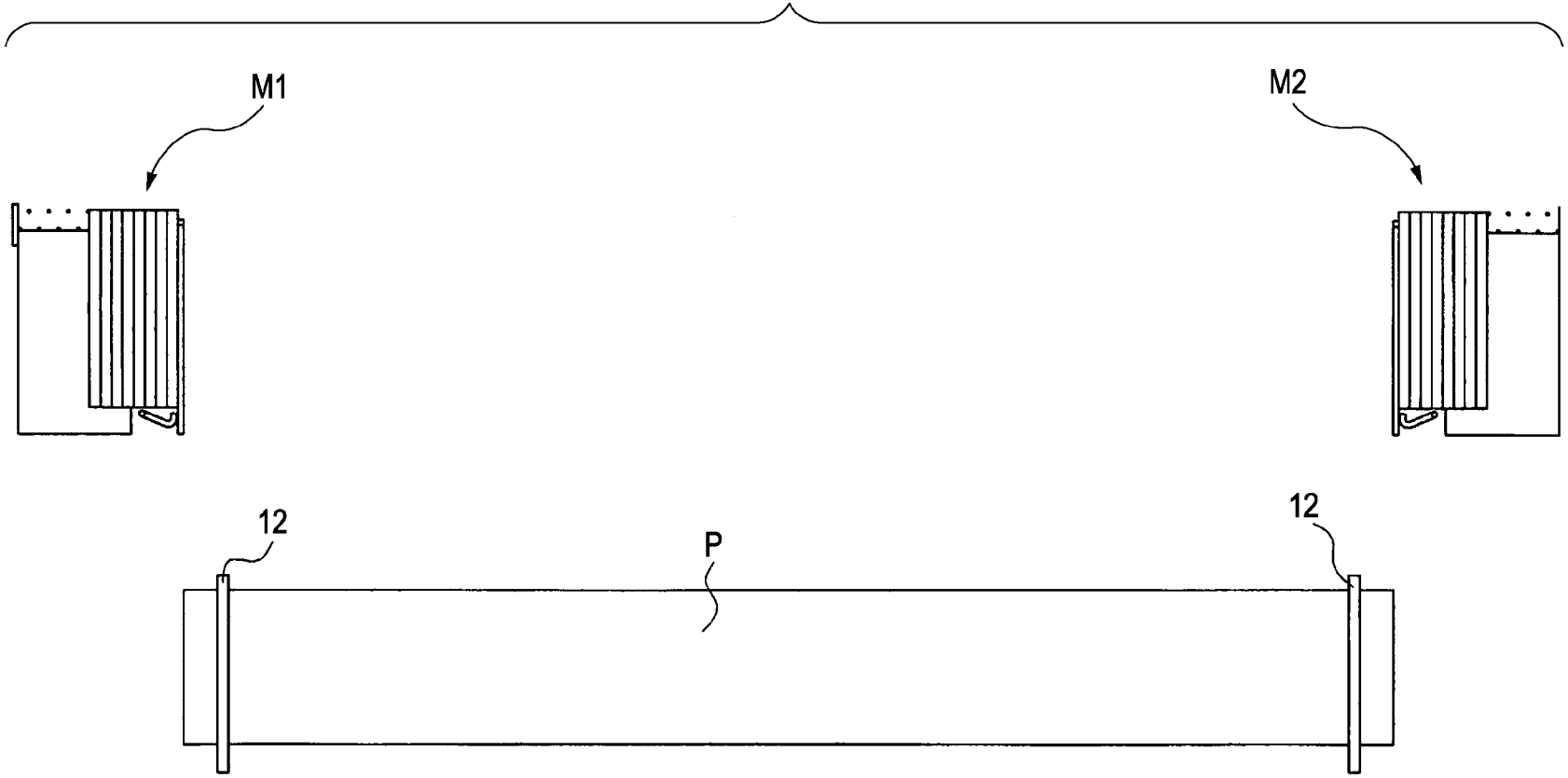
FIG. 14 illustrates an exemplary state in which the sheet rolled in cylindrical form falls from the winding apparatus according to an aspect of the present invention.

In step S10, as illustrated in FIG. 13, in order to detach the sheet rolled in cylindrical form from the paper tube 2, the paper tube 2 and the switching shaft 4 slide in the direction of the arrow H. The paper tube 2 is detached from the sheet rolled in cylindrical form, and the sheet falls on a tray (not shown), as shown in FIG. 14. At this time, since the holding rings 12 are attached to the both ends of the sheet, the sheet rolled in cylindrical form is not unfolded.

In the foregoing description, the ON and OFF states are switched by moving the switching shaft 4 outward and inward. However, another unit can be used for switching as long as the unit can move in a radial direction of the paper tube 2. Additionally, the paper tube 2 rotated by driving from the main body (not shown) in the foregoing description can be rotated by another driving. For example, a motor provided to the winding apparatus can drive the paper tube 2.

As describe above, since a long printed sheet is ejected in the form of a cylinder without having a core, continuous printing can be performed and the ease of handling sheets can be facilitated. In addition, since rolling the sheet into cylindrical form starts after the leading end of the sheet is gripped, the sheet can be rolled into cylindrical form stably irrespective of the thickness of the sheet without causing the sheet to buckle or damaging the surface of the sheet. Moreover, since the sheet is processed with a holding ring attached thereon, the sheet can be stored without causing the sheet to be unfolded.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2005-338586 filed Nov. 24, 2005, which is hereby incorporated by reference herein in its entirety.

What is claimed:

1. A sheet winding apparatus comprising:

a pair of winding units arranged about a common winding axis and opposing each other, each winding unit including, a core member configured to wind a sheet therearound;

a fixing means configured to fix a leading end of the sheet to the core member, wherein the fixing means comprises a gripper which is biased so that a grip surface is pressed against a periphery of the core member;

a releasing unit, disposed inside of the core member, configured to release the sheet from the fixing means, wherein the releasing unit moves along the common winding axis to generate a gap between the grip surface and the periphery of the core member;

a rotating unit configured to rotate the core member to wind the sheet around the core member, wherein the rotating unit comprises a driven gear formed around the core member and a drive gear meshed with the driven gear to rotate the core member; and a moving unit configured to move the core member to remove the core member from a sheet roll of the sheet wound around the core member, wherein the core member from one of the pair of winding units is disposed proximate one side of the sheet, while the core member from the other one of the pair of winding units is disposed proximate on the other side of the sheet, wherein the moving unit for each of the pair of winding units retracts its respective core member internally into its respective winding unit along the winding axis, and wherein the sheet roll falls after the core members are retracted.

2. The sheet winding apparatus according to claim 1, each winding unit further including an attaching unit configured to attach a holding member to the sheet roll, the holding member being configured to hold a rolled state of the sheet roll.

3. The sheet winding apparatus according to claim 2, wherein, after the attaching unit attaches the holding member to the sheet roll, the moving unit moves the core member.

4. The sheet winding apparatus according to claim 2, wherein the holding member comprises an elastic material having a circular ring-shape with a pair of terminus ends forming a discontinuous gap therebetween.

5. The sheet winding apparatus according to claim 1, wherein a speed of a periphery of the core members during rotation is slower than an average speed of conveying the sheet on at least an initial first lap.

6. The sheet winding apparatus according to claim 1, wherein a speed of a periphery of the core member during rotation is slower than an average speed of conveying the sheet on at least an initial first lap.

7. A recording device comprising:

a recording unit configured to perform printing on a sheet; and a pair of winding units arranged about a common winding axis and opposing each other, each winding unit including, a core member configured to wind the sheet printed by the recording unit therearound;

a fixing means configured to fix a leading end of the sheet to the core member, wherein the fixing means comprises a gripper which is biased so that a grip surface is pressed against a periphery of the core member;

a releasing unit, disposed inside of the core member, configured to release the sheet from the fixing means, wherein the releasing unit moves along the common winding axis to generate a gap between the grip surface and the periphery of the core member;

a rotating unit configured to rotate the core member to wind the sheet around the core member, wherein the rotating unit comprises a driven gear formed around the core member and a drive gear meshed with the driven gear to rotate the core member; and a moving unit configured to move the core member to remove the core member from a sheet roll of the sheet wound around the core member, wherein the core member from one of the pair of winding units is disposed proximate one side of the sheet, while the core member from the other one of the pair of winding units is disposed proximate on the other side of the sheet, wherein the moving unit for each of the pair of winding units retracts each respective core member internally into its respective winding unit along the winding axis, wherein the sheet roll falls after the core members are retracted.

8. A sheet winding unit comprising:

a core member configured to wind a sheet therearound;

a fixing means configured to fix a leading end of the sheet to the core member, wherein the fixing means comprises a gripper which is biased so that a grip surface is pressed against a periphery of the core member;

a releasing unit configured to generate a gap between the grip surface and the periphery of the core member so as to release the sheet from the fixing means, wherein the releasing unit is disposed inside of the core member;

a rotating unit configured to rotate the core member about a winding axis to wind the sheet around the core member; and a moving unit configured to move the core member to remove the core member from a sheet roll of the sheet wound around the core member, wherein the core member is configured to be disposed proximate one side of the sheet, wherein the moving unit retracts the core member internally into the winding unit along the winding axis, wherein the sheet roll falls after the core member is retracted, wherein the leading end of the sheet is gripped by the grip surface and the periphery of the core member, wherein a gap is generated between the sheet and the periphery of the core member when the sheet is wound around the core member with the gripper, and wherein, after a gap is generated between the grip surface and the periphery of the core member while the sheet is wound around the core member with the gripper, the core member is moved in a direction of the winding axis to remove the core member from the sheet roll wound around the core member with the gripper.

9. The sheet winding unit according to claim 8, further including an attaching unit configured to attach a holding member to the sheet roll, the holding member being configured to hold a rolled state of the sheet roll.

10. The sheet winding apparatus according to claim 9, wherein, after the attaching unit attaches the holding member to the sheet roll, the moving unit moves the core member.

11. The sheet winding unit according to claim 9, wherein the holding member comprises an elastic material having a circular ring-shape with a pair of terminus ends forming a discontinuous gap therebetween.

12. The sheet winding unit according to claim 8, wherein, after the releasing unit releases the sheet from the core member, the moving unit moves the core member.

* * * * *